US006065926A

United States Patent [19]

Knapp

[11] Patent Number: 6,065,926

[45] Date of Patent: May 23, 2000

[54] ADJUSTABLE FORK TRACTOR SYSTEM

[76] Inventor: Dana G. Knapp, 102 Marion, Dowagiac, Mich. 49047

[21] Appl. No.: 09/229,049

[22] Filed: Jan. 11, 1999

[51] Int. Cl.[7] ..... B66F 9/14

[52] U.S. Cl. ..... 414/667; 414/607; 414/671

[58] Field of Search ..... 414/607, 664, 414/667, 668, 671; 187/237

[56] References Cited

U.S. PATENT DOCUMENTS

| | | | |
|---|---|---|---|
| 3,232,380 | 2/1966 | Hansen | 187/237 |
| 3,356,241 | 12/1967 | Varilek | 414/671 |
| 3,498,485 | 3/1970 | Godbersen | 414/607 X |
| 3,851,779 | 12/1974 | Crawford | 414/667 |
| 3,999,675 | 12/1976 | Forry et al. | 414/667 |
| 4,113,128 | 9/1978 | Foss | 414/667 X |
| 4,221,535 | 9/1980 | Quinn | 414/671 X |
| 4,280,781 | 7/1981 | Bodin | 414/671 |
| 4,355,947 | 10/1982 | Wiblin | 414/664 X |

FOREIGN PATENT DOCUMENTS

| | | | |
|---|---|---|---|
| 2040261 | 8/1980 | United Kingdom | 414/667 |

*Primary Examiner*—James W. Keenan

[57] ABSTRACT

An adjustable fork tractor system is disclosed. The system includes a pair of adjustable forks having remote ends and having near ends with vertical support bars having lower ends attached to the forks adjacent to the near ends and having upper ends with angled support brackets coupling the support bars with the forks adjacent to their near ends. A supporting structure is provided and includes two vertically disposed beams with a horizontal connecting rod coupling the beams adjacent to their lower ends. A channel iron couples the upper ends of the beams. The channel iron has an upper edge with downwardly extending notches along the length thereof. There is provided a pair of rigid sleeves with central apertures slidably received on the rod and fixedly secured at the juncture of the forks and vertical support bars to allow the lateral sliding of the adjustable forks with respect to the rod and supporting structure. A pair of fork locks are pivotally secured to the fork beams adjacent to their upper extents with outwardly extending handles to allow the locks to be raised. The adjustable forks may be laterally adjusted toward and away from each other. In this lowered orientation the locks will be received within pre-selected notches to thereby secure the locks, vertical support beams and adjustable forks in a predetermined spaced position for operation and use as a function of the load to be lifted.

4 Claims, 2 Drawing Sheets

ADJUSTABLE FORK TRACTOR SYSTEM

BACKGROUND OF THE INVENTION

1. Field of the Invention

The present invention relates to a adjustable fork tractor system and more particularly pertains to allowing the lifting of objects having variable sizes.

2. Description of the Prior Art

The use of tractor forks of known designs and configurations is known in the prior art. More specifically, tractor forks of known designs and configurations heretofore devised and utilized for the purpose of lifting objects of various sizes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,706,388 to Westendorf discloses a Fork Attachment for a Loader Bucket. International Application Number PCT/RU93/00080 discloses a Loader. U.S. Des. Pat. No. 305,894 to Kato et al. discloses a Forklift Tractor. U.S. Pat. No. 3,574,383 to Frater discloses a Fork Lift. U.S. Pat. No. 4,640,662 to Spellman, Jr. discloses a Fork Lift Attachment for Tractor. Lastly, U.S. Pat. No. 3,876,090 to Holland discloses a Fork Lift.

While these devices fulfill their respective, particular objectives and requirements, the aforementioned patents do not describe an adjustable fork tractor system as described herein.

In this respect, the adjustable fork tractor system according to the present invention substantially departs from the conventional concepts and designs of the prior art, and in doing so provides an apparatus primarily developed for the purpose of allowing the lifting of objects having variable sizes.

Therefore, it can be appreciated that there exists a continuing need for a new and improved adjustable fork tractor system which can be used for allowing the lifting of objects having variable sizes. In this regard, the present invention substantially fulfills this need.

SUMMARY OF THE INVENTION

In view of the foregoing disadvantages inherent in the known types of tractor forks of known designs and configurations now present in the prior art, the present invention provides an improved adjustable fork tractor system. As such, the general purpose of the present invention, which will be described subsequently in greater detail, is to provide a new and improved adjustable fork tractor system and method which has all the advantages of the prior art and none of the disadvantages.

To attain this, the present invention essentially comprises a new and improved adjustable tractor fork system for allowing the lifting of objects having variable sizes comprising, in combination, a pair of parallel, laterally spaced adjustable forks having remote ends with bevelled surfaces and having near ends with vertical support bars. The vertical support bars having lower ends attached to the forks adjacent to the near ends and having upper ends with angled support brackets coupling the support bars with the adjustable forks adjacent to their near ends. Also provided is a rigid supporting structure including two parallel vertically disposed beams with lower ends and upper ends and with a horizontal connecting rod. The connecting rod couples the beams adjacent to their lower ends. An L-shaped channel iron couples the upper ends of the beams and has an upper edge with downwardly extending notches along the length thereof and with vertical apertured mounting plates secured to the channel iron adjacent to a central extent thereof for coupling to the tractor. A pair of rigid sleeves is provided with central apertures slidably received on the rod and fixedly secured at the juncture of the forks and vertical support bars to allow the lateral sliding of the adjustable forks with respect to the rod and supporting structure. A pair of outwardly extending mounting rods are secured to the beams. A pair of fork locks are pivotally secured to the vertical fork beams adjacent to their upper extents with outwardly extending handles to allow the locks to be raised between elevated orientation whereby the adjustable forks may be laterally adjusted toward and away from each other and a lowered orientation wherein the locks will be received within preselected notches to thereby secure the locks, vertical support beams and adjustable forks in a predetermined spaced position for operation and use as a function of the load to be lifted.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable fork tractor system which has all of the advantages of the prior art tractor forks of known designs and configurations and none of the disadvantages.

It is another object of the present invention to provide a new and improved adjustable fork tractor system which may be easily and efficiently manufactured and marketed.

It is further object of the present invention to provide a new and improved adjustable fork tractor system which is of durable and reliable constructions.

An even further object of the present invention is to provide a new and improved adjustable fork tractor system which is susceptible of a low cost of manufacture with regard to both materials and labor, and which accordingly is then susceptible of low prices of sale to the consuming public, thereby making such adjustable fork tractor system economically available to the buying public.

Even still another object of the present invention is to provide an adjustable fork tractor system for allowing the lifting of objects having variable sizes.

Lastly, it is an object of the present invention to provide a new and improved adjustable fork tractor system including a pair of parallel, laterally spaced adjustable forks having remote ends with bevelled surfaces and having near ends with vertical support bars having lower ends attached to the forks adjacent to the near ends and having upper ends with angled support brackets coupling the support bars with the adjustable forks adjacent to their near ends. A rigid supporting structure is provided and includes two parallel vertically disposed beams having lower ends and upper ends and with a horizontal connecting rod coupling the beams adjacent to their lower ends and having a channel iron coupling the upper ends of the beams. The channel iron having an upper edge with downwardly extending notches along the length thereof. A pair of rigid sleeves with central apertures slidably received on the rod and fixedly secured at the juncture of the forks and vertical support bars to allow the lateral sliding of the adjustable forks with respect to the rod and supporting structure. A pair of fork locks are pivotally secured to the vertical fork beams adjacent to their upper extents with outwardly extending handles to allow the locks to be raised between elevated orientation whereby the adjustable forks may be laterally adjusted toward and away from each other and a lowered orientation wherein the locks will be received within preselected notches to thereby secure the locks, vertical support beams and adjustable forks in a predetermined spaced position for operation and use as a function of the load to be lifted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
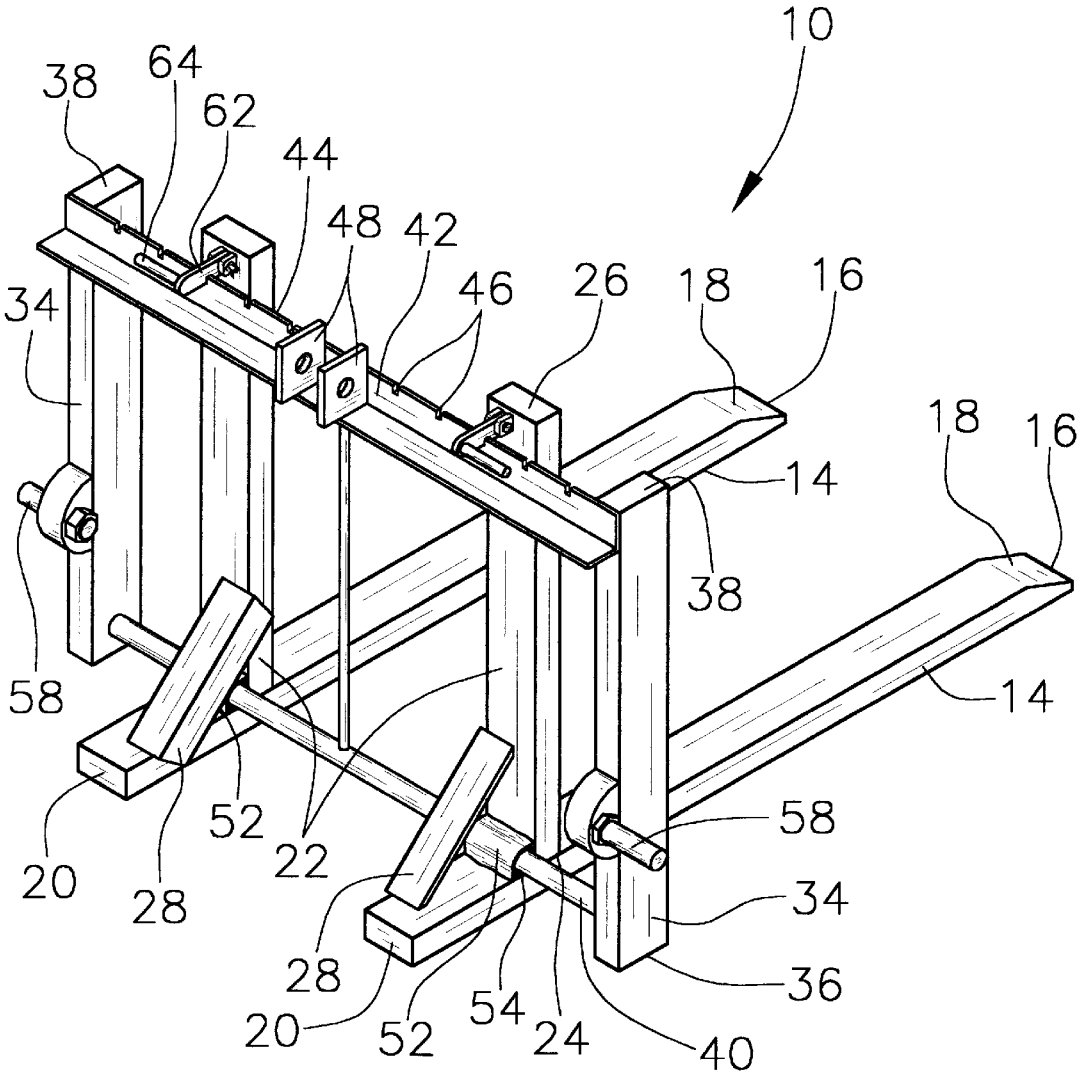
FIG. 1 is a perspective view of the preferred embodiment of the adjustable fork tractor system constructed in accordance with the principles of the present invention.
Figure 2:
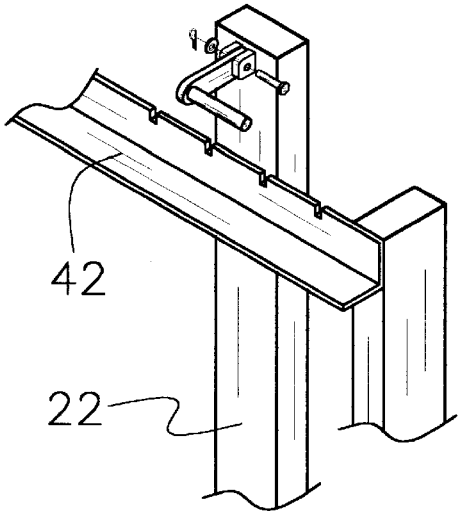
FIG. 2 is an enlarged perspective view of the upper extent of a locking mechanism.

With reference now to the drawings, and in particular to FIG. 1 thereof, the preferred embodiment of the new and improved adjustable fork tractor system embodying the principles and concepts of the present invention and generally designated by the reference numeral 10 will be described.

The present invention, the adjustable fork tractor system 10 is comprised of a plurality of components. Such components in their broadest context include a pair of parallel, laterally spaced adjustable forks, a rigid supporting structure and a pair of rigid sleeves. Such components are individually configured and correlated with respect to each other so as to attain the desired objective.

The present invention is a new and improved adjustable tractor fork system 10. The system is for allowing the lifting of objects having variable sizes. The system comprises, in combination, a pair of parallel, laterally spaced adjustable forks 14 with remote ends 16 with bevelled surfaces 18 and with near ends 20. The system also includes vertical support bars 22 having lower ends 24 attached to the forks adjacent to the near ends and having upper ends 26 with angled support brackets 28. Such brackets couple the support bars with the adjustable forks adjacent to their near ends.

Additionally provided is a rigid supporting structure 32. Such structure includes two parallel vertically disposed beams 34. Each beam has lower ends 36 and upper ends 38. A horizontal connecting rod 40 couples the beams adjacent to their lower ends. Also included is an L-shaped channel iron 42 coupling the upper ends of the beams. The channel iron has an upper edge 44 with downwardly extending notches 46 along the length thereof. Vertical apertured mounting plates 48 are secured to the channel iron adjacent to a central extent thereof for coupling to the tractor.

Also provided is a pair of rigid sleeves 52. Each sleeve has a central aperture 54 slidably received on the rod and. fixedly secured at the juncture of the forks. Vertical support bars allow the lateral sliding of the adjustable forks with respect to the rod and supporting structure.

Further provided is a pair of outwardly extending mounting rods 58 secured to the beams.

Lastly, a pair of fork locks 62 are pivotally secured to the vertical fork beams adjacent to their upper extents. Outwardly extending handles 64 allow the locks to be raised in an elevated orientation. The adjustable forks may thus be laterally adjusted toward and away from each other. The locks may also be moved to a lowered orientation wherein the locks will be received within preselected notches to thereby secure the locks, vertical support beams and adjustable forks in a predetermined spaced position for operation and use as a function of the load to be lifted.

Figure 3:
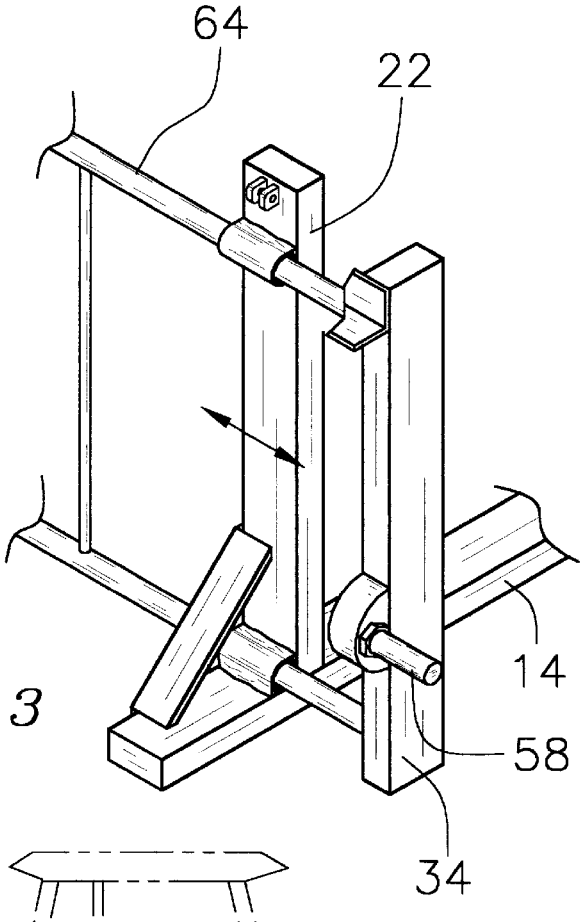
FIG. 3 is an enlarged perspective view of one-half of the system shown in FIG. 1.
Figure 4:
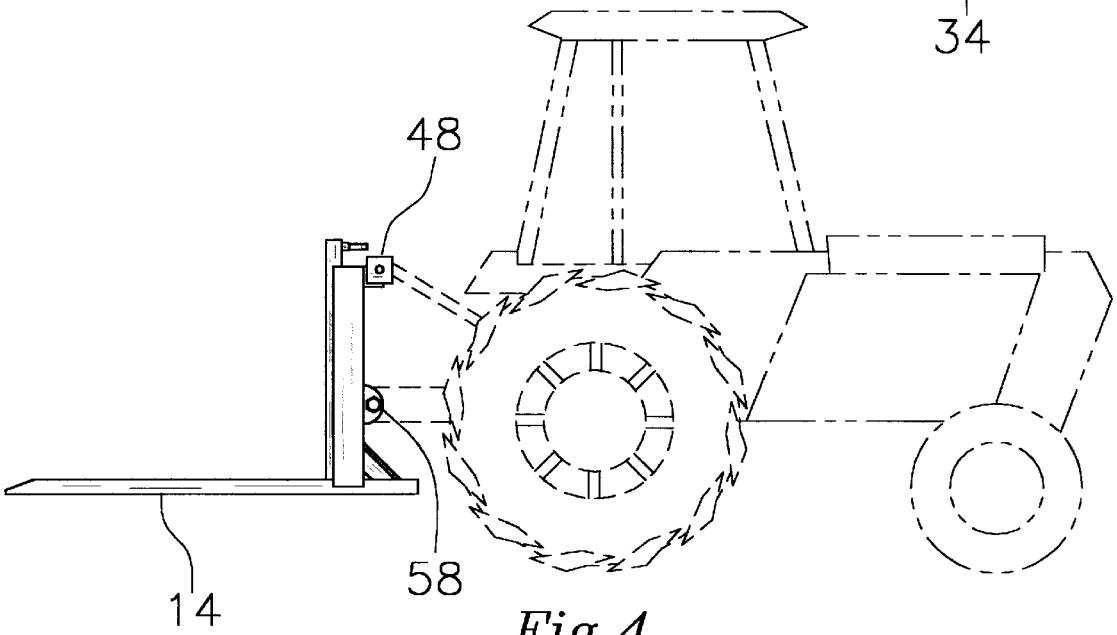
FIG. 4 is a side elevational view of the system shown in FIG. 1 as coupled to a tractor.

As shown in FIG. 3, supplemental parallelism and rigidity is attained through an upper rod 68. Such rod is secured at its ends to the upper extents of the beams with supplemental upper sleeves secured to the upper ends of the vertical support bars. This is for guiding the motion of the vertical support bars when shifting position and during operation and use.

The present invention as described hereinabove is an adjustable fork tractor system consisting of a set of adjustable-width lifting forks designed for mid-size to small tractors with 3-point hook ups. The system is manufactured from steel, cold roll shaft and angle iron.

Tractor forks offer the advantages of being able to fit even the smallest tractor with 3-point hookup, as well as larger tractors. It is designed so the pins can face out for bigger tractors or face in for smaller tractors. Additionally, the span/distance between the two forks can be adjusted to accommodate different loads.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved adjustable tractor fork system for allowing the lifting of objects having variable sizes comprising, in combination:

a pair of parallel, laterally spaced adjustable forks having remote ends with bevelled surfaces and having near ends with vertical support bars having lower ends attached to the forks adjacent to the near ends and having upper ends with angled support brackets coupling the support bars with the adjustable forks adjacent to their near ends;

a rigid supporting structure including two parallel vertically disposed beams having lower ends and upper ends and with a horizontal connecting rod coupling the beams adjacent to their lower ends and having an L-shaped channel iron coupling the upper ends of the beams, the channel iron having an upper edge with downwardly extending notches along the length thereof and with vertical apertured mounting plates secured to the channel iron adjacent to a central extent thereof for coupling to a tractor; a pair of rigid sleeves with central apertures slidably received on the rod and fixedly secured at the juncture of the forks and vertical support bars to allow the lateral sliding of the adjustable forks with respect to the rod and supporting structure;

a pair of outwardly extending mounting rods secured to the beams; and a pair of fork locks pivotally secured to the vertical support bars adjacent to their upper ends with outwardly extending handles to allow the locks to be raised between an elevated orientation whereby the adjustable forks may be laterally adjusted toward and away from each other and a lowered orientation wherein the locks will be received within preselected notches to thereby secure the locks, vertical support beams and adjustable forks in a predetermined spaced position for operation and use as a function of the size of the load to be lifted.

2. An adjustable tractor fork system comprising:

a pair of parallel, laterally spaced adjustable forks having remote ends with bevelled surfaces and having near ends with vertical support bars having lower ends attached to the forks adjacent to the near ends and having upper ends with angled support brackets coupling the support bars with the adjustable forks adjacent to their near ends;

a rigid supporting structure including two parallel vertically disposed beams having lower ends and upper ends and with a horizontal connecting rod coupling the beams adjacent to their lower ends and having a channel iron coupling the upper ends of the beams, the channel iron having an upper edge with downwardly extending notches along the length thereof;

a pair of rigid sleeves with central apertures slidably received on the rod and fixedly secured at the juncture of the forks and vertical support bars to allow the lateral sliding of the adjustable forks with respect to the rod and supporting structure;

a pair of fork locks pivotally secured to the vertical support bars adjacent to their upper ends with outwardly extending handles to allow the locks to be raised between an elevated orientation whereby the adjustable forks may be laterally adjusted toward and away from each other and a lowered orientation wherein the locks will be received within preselected notches to thereby secure the locks, vertical support beams and adjustable forks in a predetermined spaced position for operation and use as a function of the size of the load to be lifted.

3. The system as set forth in claim 2 and further including vertical apertured mounting plates secured to the channel iron adjacent to a central extent thereof for coupling to a tractor.

4. The system as set forth in claim 2 and further including a pair of outwardly extending mounting rods secured to the beams.

* * * * *